US011643747B2

(12) United States Patent
Reichert

(10) Patent No.: US 11,643,747 B2
(45) **Date of Patent: *May 9, 2023**

(54) METHOD FOR CREATING A CHROMIUM-PLATED SURFACE WITH A MATTE FINISH

(71) Applicant: Kings Mountain International, Inc., Kings Mountain, NC (US)

(72) Inventor: Jordi Reichert, Plettenberg (DE)

(73) Assignee: KINGS MOUNTAIN INTERNATIONAL, INC., Kings Mountain, NC (US)

( * ) Notice: Subject to any disclaimer, the term of this patent is extended or adjusted under 35 U.S.C. 154(b) by 11 days.

This patent is subject to a terminal disclaimer.

(21) Appl. No.: 17/234,329

(22) Filed: Apr. 19, 2021

(65) Prior Publication Data

US 2021/0238760 A1 Aug. 5, 2021

Related U.S. Application Data

(63) Continuation of application No. 16/230,264, filed on Dec. 21, 2018, now Pat. No. 10,982,344, which is a (Continued)

(51) Int. Cl.
*C25D 3/04* (2006.01)
*C25F 3/08* (2006.01)

(Continued)

(52) U.S. Cl.
CPC ..... *C25F 3/08* (2013.01); *C23F 1/26* (2013.01); *C25D 3/04* (2013.01); *C25D 3/08* (2013.01);

(Continued)

(58) Field of Classification Search
None
See application file for complete search history.

(56) References Cited

U.S. PATENT DOCUMENTS 1,645,927 A 10/1927 Pierce
3,042,592 A 7/1962 Schaer (Continued)

FOREIGN PATENT DOCUMENTS

CA 2691344 A1 1/2008
WO 8302786 A1 8/1983
WO 2011023798 A1 3/2011

OTHER PUBLICATIONS

PCT, International Search Report, dated Nov. 23, 2018 for Application No. PCT/US2018/045134, 4 pages.

(Continued)

*Primary Examiner* — Stefanie S Wittenberg

(57) ABSTRACT

A method for creating a chrome-plated surface having a matte finish that typically includes: controlling a resistance of a current bridge circuit; depositing a first chromium layer on a substrate positioned in a chromium bath, wherein the first chromium layer is deposited by supplying current from a power source that is electrically connected to the substrate and to anodes positioned in the chromium bath; etching the first chromium layer by engaging a current bridge that closes the current bridge circuit; depositing a first intermediate chromium layer, wherein the first intermediate chromium layer is deposited by supplying current from the power source; etching the first intermediate chromium layer, wherein the first intermediate chromium layer is etched by engaging the current bridge; and depositing a final chromium layer, wherein the final chromium layer is deposited by supplying current from the power source.

19 Claims, 6 Drawing Sheets

Related U.S. Application Data continuation of application No. 15/729,187, filed on Oct. 10, 2017, now Pat. No. 10,208,392.

(60) Provisional application No. 62/546,060, filed on Aug. 16, 2017.

(51) Int. Cl.

| | |
|---|---|
| ***C25D 5/14*** | (2006.01) |
| ***C25D 5/02*** | (2006.01) |
| ***C25F 7/00*** | (2006.01) |
| ***C25D 17/00*** | (2006.01) |
| ***C25D 21/12*** | (2006.01) |
| ***C25D 5/48*** | (2006.01) |
| ***C23F 1/26*** | (2006.01) |
| ***C25D 3/08*** | (2006.01) |
| ***C25D 5/00*** | (2006.01) |

(52) U.S. Cl.

CPC ..... *C25D 5/022* (2013.01); *C25D 5/14* (2013.01); *C25D 5/48* (2013.01); *C25D 5/605* (2020.08); *C25D 5/627* (2020.08); *C25D 17/005* (2013.01); *C25D 17/007* (2013.01); *C25D 21/12* (2013.01); *C25F 7/00* (2013.01)

(56) References Cited

U.S. PATENT DOCUMENTS

| | | | |
|---|---|---|---|
| 3,470,082 | A | 9/1969 | Raymond |
| 4,012,309 | A | 3/1977 | Eslien et al. |
| 4,062,741 | A | 12/1977 | Harayama |
| 4,406,756 | A | 9/1983 | Baranyi |
| 4,501,647 | A | 2/1985 | Korpi et al. |
| 4,717,456 | A | 1/1988 | Chessin et al. |
| 4,738,756 | A | 4/1988 | Mseitif |
| 5,451,299 | A | 9/1995 | Privett, III et al. |
| 10,208,392 | B1 | 2/2019 | Reichert |
| 2001/0054557 | A1 | 12/2001 | Taylor et al. |
| 2007/0026205 | A1 | 2/2007 | Anton et al. |
| 2010/0193367 | A1 | 8/2010 | Luch |
| 2012/0164350 | A1 | 6/2012 | Mayer Pujadas et al. |
| 2012/0234683 | A1 | 9/2012 | Lien et al. |

OTHER PUBLICATIONS

PCT, Written Opinion of the International Searching Authority, dated Nov. 23, 2018 for Application No. PCT/US2018/045134, 6 pages.

PCT, IPER and Written Opinion of the International Searching Authority, dated Feb. 18, 2020 for Application No. PCT/US2018/045134, 8 pages.

Notification of First Office Action and Search Report, dated Jan. 12, 2022 for Chinese Application No. 2018800530733, 9 pages.

METHOD FOR CREATING A CHROMIUM-PLATED SURFACE WITH A MATTE FINISH

CROSS-REFERENCE TO RELATED APPLICATIONS

This application is a continuation of U.S. patent application Ser. No. 16/230,264 filed Dec. 21, 2018, entitled "METHOD FOR CREATING A CHROMIUM-PLATED SURFACE WITH A MATTE FINISH," which itself is a continuation of U.S. patent application Ser. No. 15/729,187 filed Oct. 10, 2017, entitled "METHOD FOR CREATING A CHROMIUM-PLATED SURFACE WITH A MATTE FINISH," now U.S. Pat. No. 10,208,392, which claims priority to U.S. Patent Provisional Application Ser. No. 62/546,060, filed Aug. 16, 2017, entitled "METHOD FOR CREATING A CHROMIUM-PLATED SURFACE WITH A MATTE FINISH." Each of the foregoing is hereby incorporated herein by reference in its entirety.

FIELD OF THE INVENTION

The present invention embraces a method for creating a chromium-plated surface with a matte finish.

BACKGROUND

Decorative laminates have been used as surfacing material for many years, in both commercial and residential applications. Decorative laminates can provide an aesthetically pleasing surface that is more economical and/or has improved physical characteristics compared to similar looking alternatives. For example, decorative laminates can be used to create flooring that has the appearance of real hardwood flooring but is less expensive and more durable than real hardwood flooring.

In addition to flooring, decorative laminates are often used in furniture, countertops, cabinets, wall paneling, partitions, fixtures, and the like. As described above, decorative laminates can be made to resemble real wood. Decorative laminates can also be made to resemble such other materials and surfaces as stone, ceramic, marble, concrete, leather, fabric, brick, tile, and the like. In other applications, instead of being made to resemble a particular traditional material or surface, a decorative laminate may be made to provide more fanciful surfaces.

More recently, decorative laminates have been improved to include a three-dimensional "textured" surface. In this way, decorative laminates can be made to not only look like some other material or surface, but can also be made to feel like the other material or surface. In fact, decorative laminates can be made to so closely resemble the look and feel of other materials that one cannot easily determine whether the surface includes the real materials or is a faux representation of the real materials. For example, a textured decorative laminate made to look like real wood paneling may include a plurality of depressions and/or protrusions on its surface to create a texture that simulates the grains and knots of real wood boards. In another example, the textured decorative laminate may be made to look like a plurality of ceramic tiles separated by grout lines. In such an embodiment, the surface of the laminate may be made so that the images of the grout lines are depressed relative to the images of the ceramic tiles. In still other applications, textured decorative laminates may be made with more fanciful virtual artwork and may have embossing and textures that work in conjunction with the virtual artwork to create a more interesting and aesthetically pleasing surface.

In order to create a textured laminate, a press plate having depressions and/or protrusions arranged in a three-dimensional design may be pressed into a substrate. When the press plate is physically pressed into the substrate, the substrate is imprinted with the three-dimensional design present in the surface of the press plate.

To create a textured press plate, a rigid substrate may be precisely ground until a press plate substrate is substantially flat. Thereafter, a selected texture design (e.g., mask) may be printed onto the substrate to guide a subsequent etching process. Once the design is properly printed, various surface portions of the substrate may be etched based on the printed design to create a three-dimensional surface thereon. In addition, one or more layers of chromium plating may be applied to the substrate in order to protect the structured surface. The result of this etching and plating transforms the substrate into a textured (e.g., three-dimensional) press plate that can be used to produce textured decorative laminates.

In some instances, textured laminates that have multiple degrees of gloss may be desirable. In this regard, having multiple degrees of gloss may increase the variety of shadings and color reflects of a textured laminate, thus making the textured laminate appear more realistic. In order to impart various degrees onto a textured laminate, the press plate is typically formed to have corresponding degrees of gloss. In particular, the degree of gloss of different portions of the substrate and/or chromium plating layer(s) may be increased or decreased. The degree of gloss of a portion of the press plate may be increased by polishing, such as by mechanical polishing or electropolishing. The degree of gloss of a portion of the press plate may be decreased by creating a matte finish on such portion of the press plate. A matte finish may be created by chemical etching of the press plate or by applying a mechanical treatment (e.g., sandblasting) to the press plate.

SUMMARY

In one aspect, the present invention embraces a method for creating a chromium-plated surface with a matte finish.

In a first embodiment of the present invention, a method for creating a chromium-plated surface with a matte finish typically includes: controlling a resistance of a current bridge circuit; depositing a first chromium layer on the substrate, the substrate being positioned in a chromium bath, wherein the first chromium layer is deposited by supplying current from a power source, the power source being electrically connected to the substrate and to one or more terminals positioned in the chromium bath; etching the first chromium layer, wherein the first chromium layer is etched by engaging a current bridge, the current bridge, when engaged, forming an electrical connection between the substrate and the one or more terminals that closes the current bridge circuit, the current bridge circuit including the current bridge, terminals, substrate, and chromium bath; and depositing a final chromium layer, wherein the final chromium layer is deposited by supplying current from the power source.

In a particular embodiment of the first embodiment, either alone or in combination with any other particular embodiment(s) of the first embodiment, the method includes: depositing a first intermediate chromium layer on the first chromium layer after the first chromium layer has been etched, wherein the first intermediate chromium layer is deposited by supplying current from the power source;

etching the first intermediate chromium layer, wherein the first intermediate chromium layer is etched by engaging the current bridge; and wherein the final chromium layer is deposited after the first intermediate chromium layer has been etched.

In another particular embodiment of the first embodiment, either alone or in combination with any other particular embodiment(s) of the first embodiment, the method includes: depositing a second intermediate chromium layer on the first intermediate chromium layer after the first intermediate chromium layer has been etched, wherein the second intermediate chromium layer is deposited by supplying current from the power source; and etching the second intermediate chromium layer, wherein second first intermediate chromium layer is etched by engaging the current bridge; and wherein the final chromium layer is deposited after the second intermediate chromium layer has been etched.

In another particular embodiment of the first embodiment, either alone or in combination with any other particular embodiment(s) of the first embodiment, depositing the second intermediate chromium layer includes supplying current for a time period of between about two minutes and ten minutes.

In another particular embodiment of the first embodiment, either alone or in combination with any other particular embodiment(s) of the first embodiment, etching the second intermediate chromium layer includes engaging the current bridge for a time period of between about five second and thirty seconds.

In another particular embodiment of the first embodiment, either alone or in combination with any other particular embodiment(s) of the first embodiment, depositing the first chromium layer includes supplying current for a time period of between about two minutes and forty minutes.

In another particular embodiment of the first embodiment, either alone or in combination with any other particular embodiment(s) of the first embodiment, etching the first chromium layer includes engaging the current bridge for a time period of between about five second and thirty seconds.

In another particular embodiment of the first embodiment, either alone or in combination with any other particular embodiment(s) of the first embodiment, depositing the first intermediate chromium layer includes supplying current for a time period of between about two minutes and ten minutes.

In another particular embodiment of the first embodiment, either alone or in combination with any other particular embodiment(s) of the first embodiment, etching the first intermediate chromium layer includes engaging the current bridge for a time period of between about five second and thirty seconds.

In another particular embodiment of the first embodiment, either alone or in combination with any other particular embodiment(s) of the first embodiment, depositing the final chromium layer includes supplying current for a time period of between about eighty minutes and one hundred twenty minutes.

In another particular embodiment of the first embodiment, either alone or in combination with any other particular embodiment(s) of the first embodiment, the power source does not supply current while the current bridge is engaged.

In another particular embodiment of the first embodiment, either alone or in combination with any other particular embodiment(s) of the first embodiment, the current bridge is disengaged while the power source supplies current.

In another particular embodiment of the first embodiment, either alone or in combination with any other particular embodiment(s) of the first embodiment, the current bridge includes a switch, wherein the current bridge is engaged by closing the switch, and wherein the current bridge is disengaged by opening the switch.

In another particular embodiment of the first embodiment, either alone or in combination with any other particular embodiment(s) of the first embodiment, when the power source is supplying current, current flows from the one or more terminals to the substrate; and when the current bridge is engaged, current flows from the substrate to the one or more terminals.

In another particular embodiment of the first embodiment, either alone or in combination with any other particular embodiment(s) of the first embodiment, etching the first chromium layer forms a microstructure in the first chromium layer.

In another particular embodiment of the first embodiment, either alone or in combination with any other particular embodiment(s) of the first embodiment, etching the first chromium layer includes etching an outer chromium oxide layer of the first chromium layer.

In another particular embodiment of the first embodiment, either alone or in combination with any other particular embodiment(s) of the first embodiment, once the final chromium layer has been deposited, the chrome-plated surface of the substrate has a gloss level of about thirty to forty as measured at 60° using ASTM D523-14, Standard Test Method for Specular Gloss (2014).

In another particular embodiment of the first embodiment, either alone or in combination with any other particular embodiment(s) of the first embodiment, the substrate includes stainless steel.

In another particular embodiment of the first embodiment, either alone or in combination with any other particular embodiment(s) of the first embodiment, the substrate is a metallic press plate.

In another particular embodiment of the first embodiment, either alone or in combination with any other particular embodiment(s) of the first embodiment, the one or more terminals positioned in the chromium bath include one or more anodes positioned in the chromium bath.

In another particular embodiment of the first embodiment, either alone or in combination with any other particular embodiment(s) of the first embodiment, controlling the resistance of the current bridge circuit includes controlling a resistance of the chromium bath, which may be accomplished by controlling a temperature of the chromium bath and/or controlling a distance between the substrate and the one or more terminals.

In another particular embodiment of the first embodiment, either alone or in combination with any other particular embodiment(s) of the first embodiment, the current bridge includes a resistor; and controlling the resistance of the current bridge circuit includes controlling a resistance of the resistor.

In another particular embodiment of the first embodiment, either alone or in combination with any other particular embodiment(s) of the first embodiment, controlling the resistance of the current bridge circuit includes controlling the resistance of the current bridge circuit so that the resistance of the current bridge circuit is between about 0.1 milliohms and 20 milliohms when the current bridge circuit is closed.

In another particular embodiment of the first embodiment, either alone or in combination with any other particular embodiment(s) of the first embodiment, controlling the resistance of the current bridge circuit includes controlling the resistance of the current bridge circuit so that the resistance of the current bridge circuit is between about 0.8 milliohms and 8 milliohms when the current bridge circuit is closed.

In another particular embodiment of the first embodiment, either alone or in combination with any other particular embodiment(s) of the first embodiment, the chromium bath includes a chromium plating solution that includes methanesulfonic acid or any derivate of methanesulfonic acid and/or sulfuric acid.

In another particular embodiment of the first embodiment, either alone or in combination with any other particular embodiment(s) of the first embodiment, the method includes, prior to depositing the first chromium layer on the substrate, applying a mask to one or more portions of the substrate.

In another particular embodiment of the first embodiment, either alone or in combination with any other particular embodiment(s) of the first embodiment, the method includes, prior to depositing the final chromium layer, removing the mask.

In another particular embodiment of the first embodiment, either alone or in combination with any other particular embodiment(s) of the first embodiment, the method includes, prior to applying the mask to the one or more portions of the substrate, depositing a chromium layer on the substrate.

In another particular embodiment of the first embodiment, either alone or in combination with any other particular embodiment(s) of the first embodiment, the method includes, after depositing the final chromium layer, removing the mask.

In a second embodiment of the present invention, an apparatus for creating, on a substrate, a chrome-plated surface having a matte finish typically includes: a chromium plating tank; one or more terminals positioned in the chromium plating tank; a bus bar positioned above the chromium plating tank, the bus bar being configured to suspend the substrate, the bus bar being configured to be electrically connected to substrate when the substrate is suspended; a power source, the power source being electrically connected to the bus bar and to the one or more terminals positioned in the chromium plating tank; a current bridge, wherein the current bridge is configured, when engaged, to form an electrical connection between the bus bar and the one or more terminals that closes a current bridge circuit, the current bridge circuit including the current bridge, terminals, bus bar, substrate, and a chromium plating solution in the chromium plating tank; and a controller configured to control a resistance of the current bridge circuit.

In a particular embodiment of the second embodiment, either alone or in combination with any other particular embodiment(s) of the second embodiment, the bus bar is a cathode bus bar; the one or more terminals positioned in the chromium plating tank include one or more anodes positioned in the chromium bath; and a positive terminal of the power source is electrically connected to the one or more anodes, and a negative terminal of the power source is electrically connected to the cathode bus bar.

In another particular embodiment of the second embodiment, either alone or in combination with any other particular embodiment(s) of the second embodiment, the current bridge includes a switch, and the controller is configured to, when the substrate is suspended from the bus bar and positioned in a chromium plating solution in the chromium plating tank: supply current from the power source to deposit a first chromium layer on the substrate; engage the current bridge to etch the first chromium layer, wherein the current bridge is engaged by closing the switch; and supply current from the power source to deposit a final chromium layer.

In another particular embodiment of the second embodiment, either alone or in combination with any other particular embodiment(s) of the second embodiment, the controller is configured to, when the substrate is suspended from the bus bar and positioned in a chromium plating solution in the chromium plating tank: after the first chromium layer has been etched, supply current from the power source to deposit a first intermediate chromium layer on the first chromium layer; and engage the current bridge to etch the first intermediate chromium layer, wherein the current bridge is engaged by closing the switch; wherein the final chromium layer is deposited after the first intermediate chromium layer has been etched.

In another particular embodiment of the second embodiment, either alone or in combination with any other particular embodiment(s) of the second embodiment, the controller is configured to, when the substrate is suspended from the bus bar and positioned in a chromium plating solution in the chromium plating tank: after the first chromium layer has been etched, supply current from the power source to deposit a second intermediate chromium layer on the first intermediate chromium layer; and engage the current bridge to etch the second intermediate chromium layer, wherein the current bridge is engaged by closing the switch; and wherein the final chromium layer is deposited after the second intermediate chromium layer has been etched.

In another particular embodiment of the second embodiment, either alone or in combination with any other particular embodiment(s) of the second embodiment, the apparatus is configured so that the power source does not supply current while the current bridge is engaged.

In another particular embodiment of the second embodiment, either alone or in combination with any other particular embodiment(s) of the second embodiment, the apparatus is configured so that the current bridge is disengaged while the power source supplies current, the switch being open when the current bridge is disengaged.

In another particular embodiment of the second embodiment, either alone or in combination with any other particular embodiment(s) of the second embodiment, when the power source is supplying current, current flows from the one or more terminals positioned in the chromium plating tank to the substrate; and when the current bridge is engaged, current flows from the substrate to the one or more terminals positioned in the chromium plating tank.

In another particular embodiment of the second embodiment, either alone or in combination with any other particular embodiment(s) of the second embodiment, the current bridge includes a resistor.

In another particular embodiment of the second embodiment, either alone or in combination with any other particular embodiment(s) of the second embodiment, the resistor is a variable resistor; and the controller is configured to control the resistance of the current bridge circuit by controlling a resistance of the variable resistor.

In another particular embodiment of the second embodiment, either alone or in combination with any other particular embodiment(s) of the second embodiment, the controller is configured to control the resistance of the current bridge circuit by controlling a distance between the substrate and the one or more terminals.

In another particular embodiment of the second embodiment, either alone or in combination with any other particular embodiment(s) of the second embodiment, the controller is configured to control the resistance of the current bridge circuit by controlling a temperature of the chromium plating solution in the chromium plating tank.

In a third embodiment of the present invention, a method for creating a chromium-plated surface with a matte finish typically includes: controlling a resistance of a current bridge circuit by controlling the resistance of a variable resistor of the current bridge circuit; depositing a first chromium layer on the substrate, the substrate being positioned in a chromium bath, wherein the first chromium layer is deposited by supplying current from a power source, the power source being electrically connected to the substrate and to one or more terminals positioned in the chromium bath; etching the first chromium layer, wherein the first chromium layer is etched by engaging a current bridge, the current bridge, when engaged, forming an electrical connection between the substrate and the one or more terminals that closes the current bridge circuit, the current bridge circuit including the current bridge, terminals, substrate, and chromium bath; and depositing a final chromium layer, wherein the final chromium layer is deposited by supplying current from the power source.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

Figure 1A:
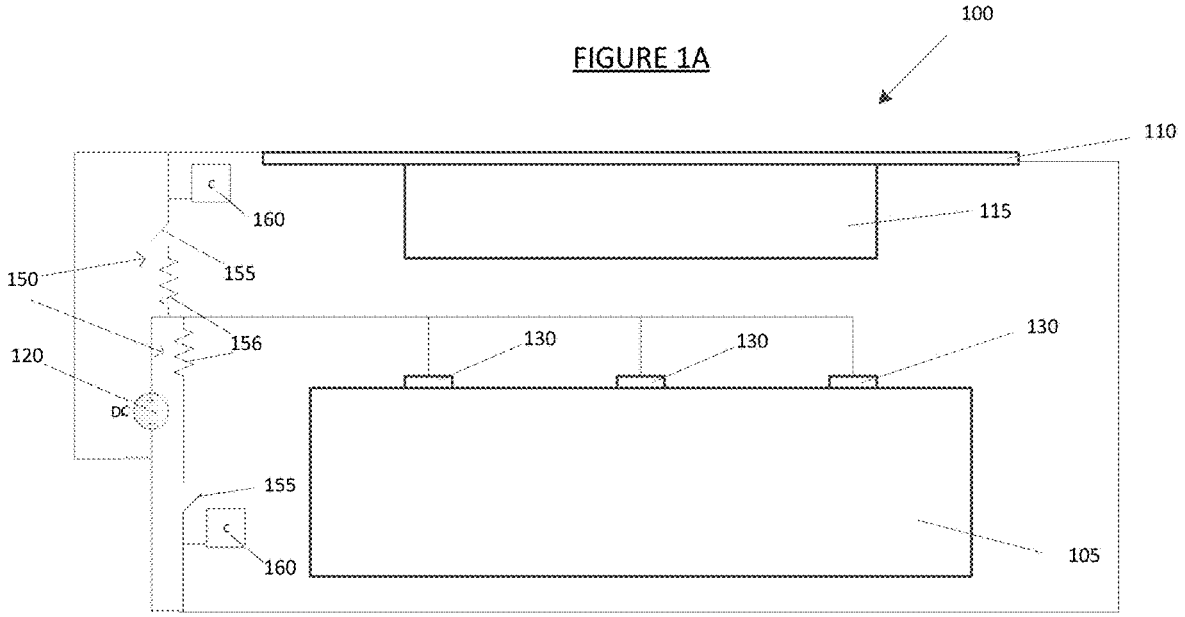

Having thus described embodiments of the invention in general terms, reference will now be made the accompanying drawings, wherein:

FIG. 1A depicts a side schematic view of an apparatus for chromium plating a substrate in accordance with one embodiment of the present invention.

Figure 1B:
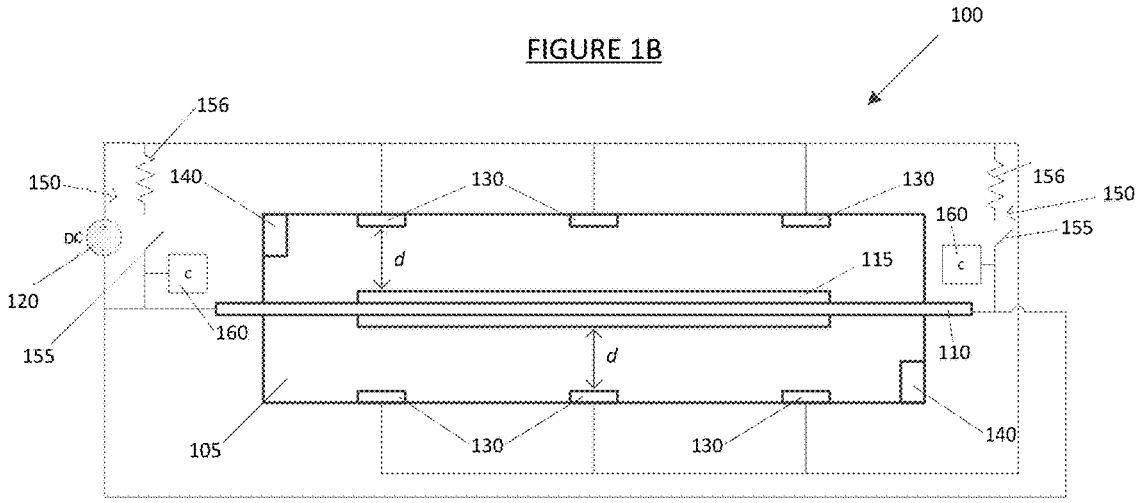

FIG. 1B depicts a top schematic view of the apparatus for chromium plating a substrate depicted in FIG. 1A.

Figure 2:
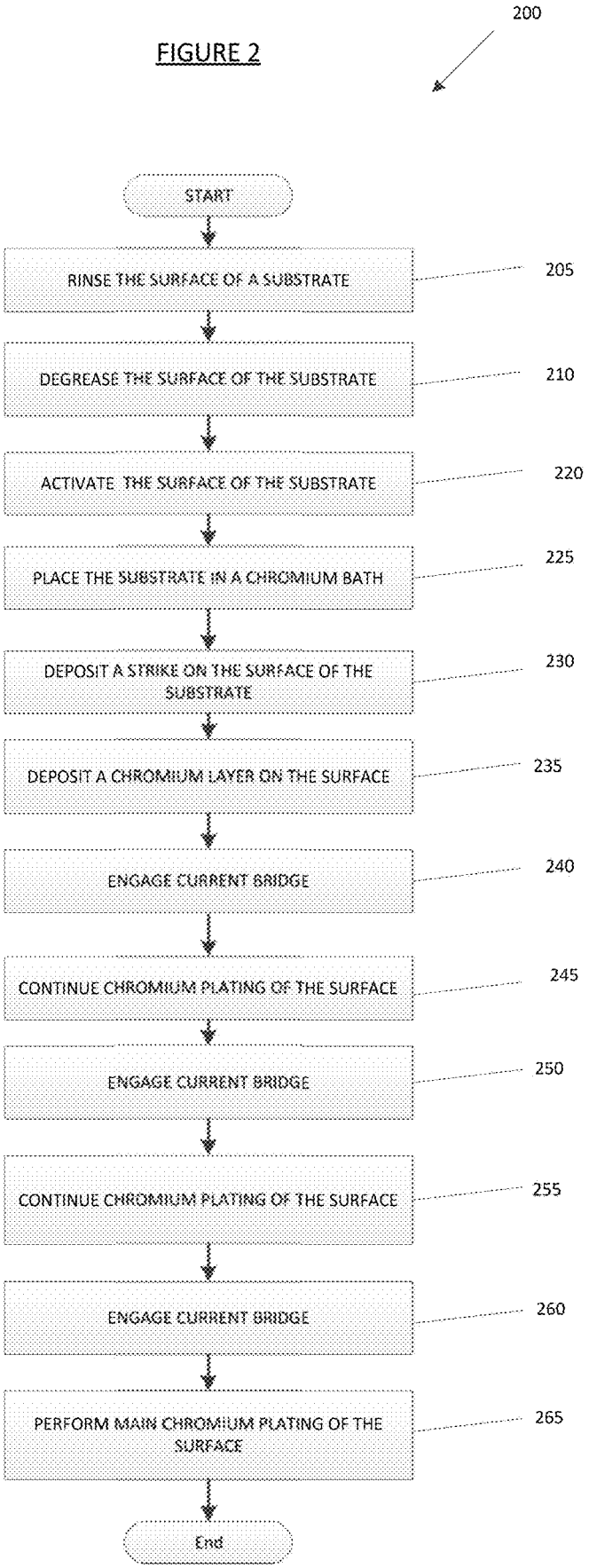

FIG. 2 depicts a method for creating a chromium-plated surface with a matte finish in accordance with one embodiment of the present invention.

FIGS. 3A-3H depict layers of chromium being deposited and etched on a substrate in accordance with the method depicted in FIG. 2.

Figure 4:
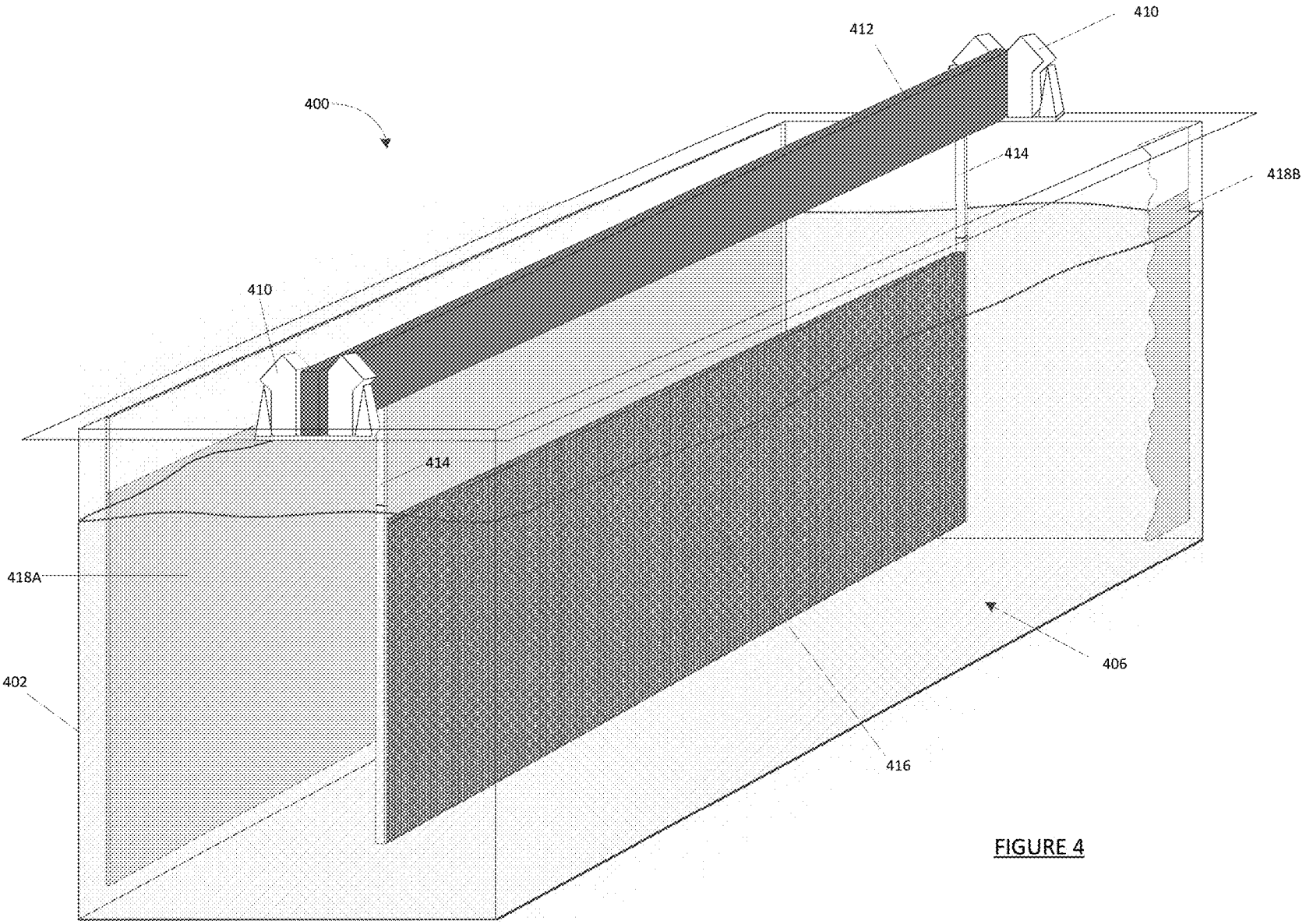

FIG. 4 depicts a perspective view of an apparatus for chromium plating a press plate in accordance with an embodiment of the present invention.

Figure 5:
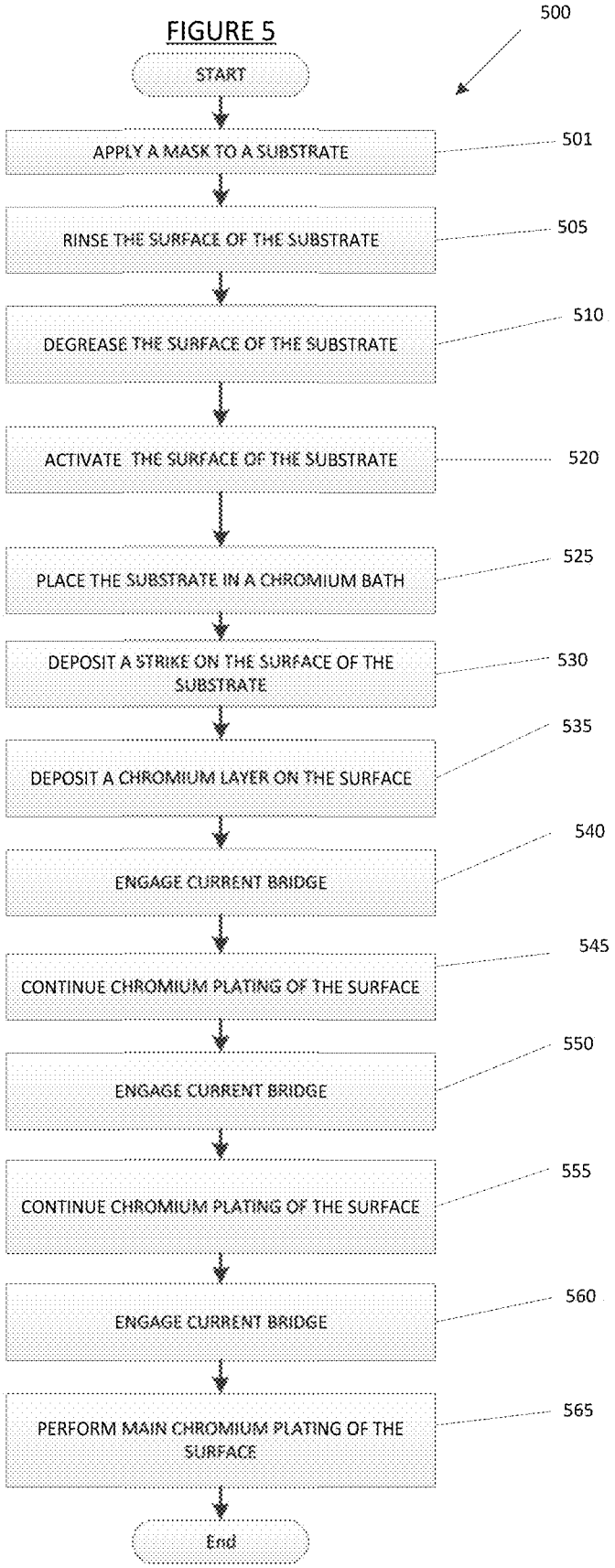

FIG. 5 depicts a method for creating a chromium-plated surface with a matte finish in accordance with another embodiment of the present invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

A matte finish on a chrome-plated surface may be created using various techniques. For example, a matte finish may be by chemical etching of a chrome-plated surface or by applying a mechanical treatment (e.g., sandblasting) to chrome-plated surface.

A matte finish may be formed on a chrome-plated surface through pulse plating. During pulse plating, instead of supplying a constant direct current to a chromium bath during chromium plating, direct current is supplied as a series of pulses. Chromium deposited during pulse plating may have a matte appearance. Pulse plating; however, can be difficult to implement, particularly in an industrial setting. For example, the pulsed direct current used during pulse plating forms a strong magnetic field that can damage nearby equipment.

Another technique for creating a matte finish is to print a matrix of very small chemically resistant ink dots on a chrome-plated surface and then etching the chrome-plated surface. A frequency modulated raster may be used to define the density/concentration of such dots. By changing the frequency (i.e., density or concentration) of the chemically resistant ink dots, the degree of matte finish can be controlled.

Yet another technique for creating a chrome-plated surface with a matte finish is to depart from the typical current densities and/or chromium bath temperatures used to deposit hard chrome. In this regard, depositing hard chrome on a surface typically requires that the chromium bath temperature and the current density used during deposition be maintained within known ranges. That said, if the chromium bath temperature is lowered to be below the temperatures used for depositing hard chrome, or if the current density is increased to be above the current densities used for depositing hard chrome, then the chromium deposited has a matte/dull appearance, rather than the typical glossy appearance of deposited hard chrome. However, this technique (i.e., lowering the temperature or increasing the current density) is undesirable as the chromium deposited is brittle and soft.

That said, a need exists for an improved method of creating a chromium-plated surface having a matte finish.

Therefore, in one aspect, the present invention embraces a method for creating a chromium-plated surface having a matte finish. In this regard, a substrate is placed in a chromium bath after cleaning and activation. The substrate is typically connected to a cathode bus bar thereby forming a cathode in the chromium bath. One or more electric terminals, typically anodes, are also placed in the chromium bath. The anode(s) and cathode are connected to a power source such that electric current flows from the anode(s) to the cathode through the chromium bath. This current flow causes chromium in the chromium bath to be deposited as chromium metal on the surface of the substrate. Following formation of the chromium layer on the plate via chromium plating, a layer of chromium oxide forms on the outer surface of the chromium layer due to the outer surface of the deposited chromium layer chemically reacting with chrome oxide in the bath. In order to cause the chromium plated surface to have a matte finish, the outer chromium layer of the substrate (e.g., the outer chromium oxide layer and possibly the chromium metal underneath) is then etched or otherwise disrupted. Although this etching does not cause the etched chromium layer to have a matte appearance, after this etching, subsequently deposited layers of chromium have a matte appearance instead of a glossy appearance. This etching is typically performed by causing chromic acid in the chromium bath to attack the outer chromium layer (e.g., the deposited chromium metal and chromium oxide). In this regard, it is important to note that due to the distribution of charged particles in the chromium bath and the chromium plated substrate, a voltage exists between the anode(s) and cathode. Because this voltage arises from the distribution of charged particles, this voltage remains even when the power source is turned off. Moreover, this voltage has the effect of protecting the deposited chromium (e.g., chromium metal and chromium oxide) from being attacked by chromic acid in the chromium bath. Therefore, in order to cause the chromic acid to attack the outer chromium layer of the substrate, this voltage is reduced. This voltage is typically reduced by turning the power source off and, while the power source is off, temporarily engaging a current bridge (e.g., a short) between the anode(s) and cathode. Due to the voltage that exists between the anode(s) and cathode, when the current bridge is engaged and the power source is off, current flows between the anode(s) and cathode and in the opposite direction of current flow during chromium deposition. This current flow causes the voltage between the cathode and the anodes to breakdown (i.e., decrease). Once the voltages sufficiently breaks down, the chromic acid in the chromium bath attacks the outer chromium layer of the substrate, thereby etching the outer chromium oxide layer formed on the surface of the chromium layer and possibly etching the chromium metal underneath the chromium oxide layer. In particular, this etching typically forms a microstructure in the outer chromium layer (e.g., in the outer surface of the outer chromium layer). As noted, after this etching, subsequently deposited layers of chromium metal have a matte appearance, instead of a glossy appearance. In particular, it is thought that depositing a layer of chromium on the microstructure formed on the previously etched chromium layer causes the later deposited chromium to have a matte appearance. By depositing chromium with a matte appearance in this manner, it is possible to achieve a chromium-plated surface with a matte appearance, rather than a glossy appearance, without employing subsequent chemical or mechanical processing (e.g., chemical etching or sandblasting) after the substrate has been chromium plated.

FIGS. 1A and 1B depict an apparatus 100 for chromium plating a substrate in accordance with one embodiment of the present invention. The apparatus 100 typically includes a chromium plating tank 105. The chromium plating tank 105 is typically configured to be filled with a chromium plating solution. Chromium plating solutions typically include chromic acid and one or more catalysts, such as a sulfate and/or fluoride catalysts. In typical embodiments, the chromium plating solutions includes two catalysts, such as sulfuric acid and methanesulfonic acid (or any derivative of methanesulfonic acid). An exemplary chromium plating solution is HEEF® 25, which includes chromic acid and two sulfate catalysts, namely sulfuric acid and methanesulfonic acid, which is available from Atotech USA Inc. The chromium plating tank 105 is typically formed from or lined with a material that is both nonconductive and nonreactive (or minimally reactive) to the chromium plating solution. For example, the chromium plating tank 105 may be lined with polyvinyl chloride (PVC). That said, the chromium plating tank 105 may be formed from any other suitable material.

The apparatus 100 typically includes a cathode bus bar 110 from which a substrate 115 to be chromium plated may be suspended. The cathode bus bar 110 is typically connected to a negative terminal of a power source 120 (e.g., a direct current (DC) power source, such as a rectifier) and formed from a conductive material (e.g., copper). As depicted in FIGS. 1A-1B, opposing ends of the cathode bus bar 110 may each be connected to the negative terminal of the power source 120. The substrate 115 to be plated is, in this embodiment, connected to the cathode bus bar. In addition to being mechanically suspended from the cathode bus bar 110, the substrate 115 (which is typically formed from a conductive material) is electrically connected to the cathode bus bar 110 so that the substrate 115 forms a cathode during chromium plating. In this regard, the substrate 115 may be suspended from the cathode bus bar 110 via conductive hangers. The cathode bus bar 110 is typically configured to be vertically movable relative to the chromium plating tank 105 so that the substrate 115 may be placed in or removed from the chromium plating solution in the chromium plating tank 105. In some embodiments, the cathode bus bar 110 may be connected to a hydraulic, pneumatic, or mechanical actuator (not depicted) to provide this vertical movement.

The substrate 115 is typically a metallic substrate, such as a metallic press plate. In a particular embodiment, the press plate is made from stainless steel (e.g., 410- or 630-grade hardened stainless steel). The press plate may be a textured press plate. In this regard, U.S. Pat. No. 8,778,202, which is hereby incorporated by reference in its entirety, describes a method of creating a textured press plate. That said, the substrate 115 may be any other material that is suitable to be chromium plated. In some instances, the substrate 115 may have been previously chromium plated. For example, the substrate 115 may have an outer chromium layer with a glossy appearance.

The apparatus 100 typically includes one or more terminals positioned in the chromium plating tank 105. These terminals are typically connected to a positive terminal of the power source 120, and so FIGS. 1A and 1B depict these terminals as one or more anodes 130. The one or more anodes 130 are typically formed from a material that is conductive, but does not react (or minimally reacts) with the chromium plating solution. For example, the one or more anodes 130 may be formed from a lead alloy (e.g., a lead and tin alloy or a lead and antimony alloy). To facilitate uniform deposition of chromium metal on the surface of the substrate 115, each of the anodes 130 is typically positioned an equal distance d from the substrate 115. In some embodiments, the position of the one or more anodes 130 is fixed. For example, the one or more anodes 130 may be attached to the inner sidewalls of the chromium plating tank 105 as depicted in FIG. 1B. In alternative embodiments, the position of the one or more anodes 130 may be adjustable. For example, the anodes 130 may be suspended from one or more anode bus bars (not depicted). Such anode bus bars may be laterally moveable relative to the position of the substrate 115 so that the distance d between the anodes 130 and the substrate 115 may be increased or decreased to thereby alter the plating process.

It may be desirable to heat the chromium plating solution above room temperature. Accordingly, one or more heaters 140 may be positioned in the chromium plating tank 105.

The apparatus 100 typically includes one or more current bridges 150 between the anodes 130 and the cathode bus bar 110. Each current bridge 150 typically includes a switch 155 that may be opened or closed. Each current bridge 150 typically has a relatively low resistance when the switch 155 is closed. As depicted in FIGS. 1A-1B, in some embodiments the current bridge 150 may include one or more resistors 156 (e.g., variable resistors). In other embodiments, the current bridge 150 does not include a resistor. One or more controllers 160 may be used to control the operation of the switch(es) 155. The one or more controllers 160 may also be configured to control other aspects of the apparatus 100 (e.g., controlling delivery of current from the power source 120). In this regard, each controller 160 is typically a computing device or computing system that is configured to control the operation and/or other aspects of the apparatus 100, such as controlling the operation of the switch(es) 155.

During chromium plating, the anodes 130 and the cathode bus bar 110 are electrically connected to the power source 120 such that current flows from the power source 120 to the anodes 130 and from the cathode bus bar 110 to the power source 120. When the power source 120 is on during chromium plating, the switch 155 of each current bridge 150 typically remains in an open position, and, thus, substantially no current flows through the current bridge(s).

In order to facilitate etching of the surface of the layer of chrome plating on the substrate 115, the power source 120 is typically turned off. Even though the power source 120 is off, a voltage exists between the cathode (the substrate 115) and the anodes 130. This voltage between the cathode (the substrate 115) and the anodes 130 is typically about 1.3 volts. When the power source 120 is turned off (or does not otherwise supply current to the cathode and anodes 130), and the switch 155 is open, typically substantially no current flows between the cathode (the substrate 115) and the anodes 130. That said, once, the power source 120 is turned off, the current bridge(s) 150 may be engaged by closing the switch(es) 155. Once the current bridge(s) 150 are engaged by closing the switch(es) 155, the current bridge(s) 150 close the circuit or "current bridge circuit" between the cathode (the substrate 115) and the anodes 130, thus allowing current to flow between the cathode and the anodes 130. The current bridge circuit includes the current bridge 150 (including any resistors 156), the cathode (the substrate 115), the anodes 130, and the chromium bath. The current flow through the current bridge circuit, when the current bridge circuit is closed, is typically in the opposite direction of the current flow when the power source 120 is supplying current. In other words, when current is supplied from the power source 120, current flows from the positive terminal of the power source 120 to the anodes 130, from the anodes 130 to the substrate 115 through the chromium bath, from the substrate 115 to the cathode bus bar 110, and from the cathode bus bar 110 to the negative terminal of the power source 120. Whereas, when the one or more current bridges 150 are engaged, current flows from the cathode (the substrate 115) to the anodes 130 through the chromium bath, and from the anodes 130 back to the cathode (the substrate 115) via the current bridge 150 and the cathode bus bar 110. This current flow from the substrate to the anodes etches or otherwise disrupts the chromium oxide formed on the chromium layer on the substrate 115 and may etch the chromium metal underneath the chromium oxide.

FIG. 2 depicts a general process flow 200 for creating a chromium-plated surface with a matte finish on a substrate (e.g., the substrate 115) in accordance with one embodiment of the present invention. As previously noted, the substrate 115 may be a textured press plate. Accordingly, prior to the process described herein for creating a chromium-plated surface with a matte finish, the substrate 115 may be have previously processed to be textured (e.g., to have various ridges and/or valleys on its surface that formed a desired textured pattern on the substrate 115). For example, if the substrate 115 is intended to be used as a press plate for forming textured decorative laminates that resemble real wood paneling, a textured pattern formed on the surface of the substrate 115 may include depressions and/or protrusions that simulates the grains and knots of real wood boards. To form a textured pattern on the substrate 115, a selected texture design (e.g., mask) may be printed onto the substrate 115 to guide a subsequent etching process. In this regard, U.S. Pat. No. 8,778,202 describes a method of applying a chemically resistant ink to the surface of a press plate. In some embodiments, this chemically resistant ink is a hot-melt ink. Once the design is properly printed, various surface portions (e.g., exposed surface portion) of the substrate 115 may be etched based on the printed design to create a three-dimensional surface thereon. These steps of printing a mask on the substrate 115 followed by corresponding etching of the exposed (e.g., not covered by a mask) portions of the substrate 115 may be repeated until the desired textured pattern is achieved.

The described process for creating a chromium-plated surface with a matte finish may be used to provide a gloss-level (e.g., a matte appearance) to either the entire surface of the substrate 115 or, as described in more detail below with respect to FIG. 5, to portions of the surface of the substrate 115. Accordingly, prior to depositing chromium in the below-described process, a mask may be applied to (e.g., printed on) the substrate 115 such that the chromium is only deposited on portions of the substrate 115 not covered by such mask.

Before the substrate 115 is chromium plated, the surface of the substrate 115 is typically cleaned and activated. In this regard, at step 205, the surface of the substrate 115 (e.g., a textured stainless steel press plate) is rinsed to remove contaminants. Next, at step 210, the surface of the substrate 115 is degreased (e.g., by applying a suitable solvent or employing electrolytic degreasing) to remove any oil and grease and subsequently rinsed. At step 220, the surface of the press plate 115 is activated. Activating the surface of the substrate 115 may improve the adhesion of chromium metal to the substrate 115 and may remove any oxides remaining on the substrate 115. To activate the surface of the substrate 115, the substrate may be exposed to sulfuric acid or a reverse etch bath having a chromic acid solution with no sulfate. Thereafter, the substrate 115 may be rinsed again. Alternatively, the surface of the substrate 115 may be activated by pickling, namely by exposing the surface to a strong acid. This pickling facilitates the removal of rust and scale from the substrate 115.

Once the substrate 115 has been cleaned and activated (e.g., using the process described with respect to steps 205-220), the substrate 115 may be chromium plated. In this regard, at step 225, the substrate 115 is placed in a chromium bath. For example, the substrate 115 may be attached (e.g., mechanically and electrically connected) to the cathode bus bar 110 and lowered into the chromium plating tank 105 so that at least most of the substrate 115 is submerged in the chromium plating solution. At this time, the switch 155 of each current bridge 150 typically remains in the open position, and, thus, no current is flowing through the current bridge(s). Moreover, the switch 155 of each current bridge 150 typically remains in the open position so that no current flows through the current bridge(s) whenever the power source 120 is supplying current.

At step 230, a strike is deposited on the surface of the substrate 115 by supplying current from the power source 120 to the one or more anodes 130 and the cathode (e.g., by turning on the power source 120). A strike is a thin plating (in this instance of chromium) on the surface of the substrate 115 that is of high quality and adheres well to the substrate 115. The current supplied by the power source causes chemical reactions to occur in the chromium bath that result in chromium from the chromium plating solution being deposited on the substrate 115. In order to deposit the strike on the substrate 115, a higher current density is typically employed as compared to the current density employed for subsequent chromium plating. For example, a current density of 16 A/dm$^2$ may be employed to deposit the strike on the substrate, whereas a current density of 10 A/dm$^2$ may be employed during subsequent chromium plating. As used herein, the current density is the amperage provided by the power source 120 divided by the surface area of the substrate 115. To deposit the strike, the substrate 115 may be subjected to this current density for between about two to six minutes (e.g., about four minutes). In some embodiments, the current density is increased for a period of time before the current density for depositing the strike is reached. For example, the current density may linearly increase (e.g., from a current density of 0 A/dm$^2$ to a current density of 16 A/dm$^2$) for a period of about two minutes and then remain steady for a period of about four minutes (e.g., at a current density of 16 A/dm$^2$) while the strike is deposited.

After the strike has been deposited on the surface of the substrate 115, at step 235, an initial chromium layer (e.g., of a desired thickness) is deposited on the substrate 115 (i.e., on the previously deposited strike) by supplying current from the power source 120 to the one or more anodes 130 and the cathode. In this regard, the current supplied by the power source 120 causes chemical reactions to occur in the chromium bath that result in chromium from the chromium plating solution being deposited on the substrate 115. As noted above, a lower current density is typically employed to perform this chromium plating as compared to the current density employed to deposit the strike on the substrate 115. In some embodiments, the current density provided by the power source 120 is typically reduced (e.g., from 16 A/dm$^2$ to 10 A/dm$^2$) once the strike has been deposited in order to initiate this chromium plating step.

The thickness of the chromium layer deposited as a result of this chromium plating step is typically based, among other things, on the length of time of this chromium plating step. Because etching is subsequently performed, it is typically desirable to ensure that this chromium layer is of sufficient thickness so that subsequent etching does not etch entirely through the chromium layer to the substrate 115. Accordingly, this initial chromium plating step is typically performed for a sufficient period of time (e.g., between about 20-40 minutes) so that this deposited chromium layer has a sufficient thickness to ensure subsequent etching does not etch through this initial chromium layer to the substrate 115.

Once this chromium plating step is complete, the power source 120 is typically turned off (or otherwise does not supply current to the cathode (the substrate 115) and the anodes 130). At this point, the outer surface of the initial chromium layer will typically oxidize with chrome oxide in the chromium bath, such that the initial chromium layer has a thin chromium oxide layer on its outer surface with chromium metal underneath.

As noted, even though current is no longer being supplied to the cathode and anodes 130 from the power source 120, a voltage (e.g., of about 1.3 volts) exists between the cathode and the anodes 130. This voltage exists because of the distribution of charged particles in the chromium bath and the chromium deposited on the substrate 115. As a byproduct, this voltage protects the chromium oxide and chromium metal deposited on the substrate 115 from being attacked by the chromic acid in the chromium plating solution.

Typically, the chemical reaction that takes place during chromium plating causes the formation of hydrogen gas in the chromium plating solution. In some embodiments, the chromium plating solution is allowed to settle while current is no longer being supplied to the cathode and anodes 130 before the next step of engaging the current bridge. This settling period allows the hydrogen gas to leave the chromium plating solution. The settling period may be between about 10 seconds and 60 seconds, such as about 20 seconds.

Next, the initial chromium layer is etched. As described above, although this etching typically does not result in the initial chromium layer having a matte appearance, this etching does help to cause subsequently deposited chromium layers to have a matte appearance. In order to facilitate etching of the initial chromium layer, at step 240, the one or more current bridges 150 are engaged by closing each current bridge's switch 155. As noted, before the one or more current bridges 150 are engaged, no current flows between the anodes 130 and the cathode (the substrate 115), because the power source 120 is not supplying current and there is an open circuit between the anodes 130 and the cathode. However, by engaging the one or more current bridges 150, the current bridge circuit that includes the anodes 130 and the cathode is completed, thus allowing current to flow between the cathode and the anodes 130. This current flow is typically in the opposite direction of the current flow when the power source 120 is on. The amount of this current depends on the voltage between the cathode and the anodes 130 (e.g., about 1.3 volts), the electrical resistance of the chromium plating solution (e.g., about 8 milliohms), and the electrical resistance of the resistor(s) 156, if any, of the current bridges 150, as well as any other resistance included within the current bridge circuit (e.g., any nominal resistance of the cathode bus bar 110, substrate 115, and anodes 130). This current flows causes the voltage between the cathode and the anodes 130 to breakdown (i.e., decrease). As this voltage decreases, this voltage becomes less able to protect the chromium oxide and chromium metal deposited on the substrate 115 from being attacked by the chromic acid in the chromium plating solution. Once the voltages sufficiently breaks down, the chromic acid in the chromium plating solution attacks the initial chromium layer. In particular, the chromic acid typically etches the thin outer layer of chromium oxide and may etch the chromium metal underneath the chromium oxide. As noted, the initial chromium layer is typically of sufficient thickness to prevent the substrate 115 itself from being etched. This etching typically causes the surface of the initial chromium layer deposited in step 235 to have a microstructure. Although the initial chromium layer now has a microstructure, if the chromium plated substrate were removed from the chromium bath immediately after the etching in step 240, the chromium plated substrate would typically have a glossy rather than matte appearance. Accordingly, as described in more detail below, additional chromium plating and etching steps are performed.

The one or more current bridges 150 typically remain engaged for a relatively short period of time, typically between about 5-30 seconds, more typically between about 10-20 seconds (e.g., 12 seconds). As noted, during this period of time, flowing current causes the voltage between the cathode and the anodes 130 to breakdown, thereby allowing the chromic acid in the chromium plating solution to etch the initial chromium layer. After this period of time, the one or more current bridges 150 are typically disengaged (e.g., by opening each current bridge's switch 155), thereby ceasing this current flow and the etching of the initial chromium layer.

After the one or more current bridges 150 are disengaged, at step 245, power is again supplied by the power source 120, and a second chromium layer is deposited on the substrate. In other words, the second chromium layer is deposited on the etched initial chromium layer. The current density provided by the power source 120 during this deposition step is typically the same current density used to deposit the initial chromium layer (e.g., about 10 A/dm$^2$). Typically, the thickness of the second chromium layer is less than the thickness of the initial chromium layer. In this regard, this step 245 of chromium plating to achieve the second chromium layer may occur for a period of between about two minutes and ten minutes (e.g., about five minutes). In some embodiments, the current density may linearly increase (e.g., from a current density of 0 A/dm$^2$ to a current density of 10 A/dm$^2$) for a period of about one minute and then remain steady for a period of about five minutes (e.g., at a current density of 10 A/dm$^2$) while the second chromium layer is deposited.

As noted, the second chromium layer is deposited on the etched initial chromium layer. In other words, the second chromium layer is typically deposited on the microstructure formed by etching the initial chromium layer. Applicant has found that this second chromium layer has a matte appearance. It is thought that depositing the second chromium layer on the microstructure of the etched initial chromium layer causes the second chromium layer to have a matte appearance. Applicant, however, has further found that this matte appearance typically lacks uniformity. That said, Applicant has further found that by employing multiple iterations of etching the most recently deposited chromium layer by engaging the one or more current bridges 150 followed by a subsequent step of chromium plating, it is possible to achieve chromium plating with a substantially uniform matte appearance.

Therefore, at step 250, the second chromium layer is etched by engaging the one or more current bridges 150 a second time (e.g., by closing each current bridge's switch 155). Typically, the power source 120 is turned off (or otherwise disconnected from the cathode (the substrate 115) and the anodes 130), and the chromium plating solution is allowed to settle (e.g., for a period of between about 10 seconds and 60 seconds, such as about 20 seconds), prior to engaging the one or more current bridges 150. When the power source 120 is turned off, the outer surface of the second chromium layer will typically oxidize with chrome oxide in the chromium bath, such that the second chromium layer has a thin chromium oxide layer on its outer surface with chromium metal underneath. The one or more current bridges 150 typically remain engaged for a relatively short period of time, such as between about 5-20 seconds (e.g., 12 seconds). Similar to the process described in step 240, engaging the one or more current bridges 150 typically causes the chromic acid in the chromium plating solution to etch the thin outer layer of chromium oxide of the second chromium layer and may etch the chromium metal underneath the chromium oxide, thus forming a microstructure in the second chromium layer.

At step 255, the one or more current bridges 155 are disengaged, power is again supplied by the power source 120, and chromium plating of the surface of the substrate 115 is continued by depositing a third chromium layer. In other words, the third chromium layer is typically deposited on the microstructure formed by etching the second chromium layer. The current density provided by the power source 120 during this deposition step is typically the same current density used to deposit the initial chromium layer (e.g., about 10 A/dm$^2$). Typically, the thickness of the third chromium layer is less than the thickness of the initial chromium layer. In this regard, this step 255 of chromium plating to achieve the third chromium layer may occur for a period of between about two minutes and ten minutes (e.g., about five minutes). In some embodiments, the current density may linearly increase (e.g., from a current density of 0 A/dm$^2$ to a current density of 10 A/dm$^2$) for a period of about one minute and then remain steady for a period of about five minutes (e.g., at a current density of 10 A/dm$^2$) while the third chromium layer is deposited. This third chromium layer typically has matte appearance. Although this matte appearance is typically more uniform than the matte appearance after step 245, this matte appearance may have visual imperfections.

Therefore, at step 260, the third chromium layer is etched by engaging the one or more current bridges 150 a third time (e.g., by closing each current bridge's switch 155). Typically, the power source is turned off (or otherwise disconnected from the cathode (the substrate 115) and the anodes 130), and the chromium plating solution is allowed to settle (e.g., for a period of between about 10 seconds and 60 seconds, such as about 20 seconds), prior to engaging the one or more current bridges 150. When the power source 120 is turned off, the outer surface of the third chromium layer will typically oxidize with chrome oxide in the chromium bath, such that the third chromium layer has a thin chromium oxide layer on its outer surface with chromium metal underneath. The one or more current bridges 150 typically remain engaged for a relatively short period of time, such as between about 5-20 seconds (e.g., 12 seconds). Similar to that described in step 240, engaging the one or more current bridges 150 typically causes the chromic acid in the chromium plating solution to etch the thin outer layer of chromium oxide of the third chromium layer and may etch the chromium metal underneath the chromium oxide, thus forming a microstructure in the third chromium layer.

At step 265, the one or more current bridges 155 are disengaged, power is again supplied by the power source 120, and chromium plating of the surface of the substrate 115 is continued by depositing a fourth chromium layer. In other words, the fourth chromium layer is deposited on the microstructure created by etching the third chromium layer. The current density provided by the power source 120 during this deposition step is typically the same current density used to deposit the initial chromium layer (e.g., about 10 A/dm$^2$). This fourth chromium layer is typically the final chromium layer applied to the substrate 115. In addition, this fourth chromium plating typically constitutes the main chromium plating of the substrate 155. In other words the majority (or plurality) of chromium to be deposited on the substrate 115 is typically deposited during this fourth chromium plating step (i.e., step 265). Accordingly, this fourth chromium plating is typically performed for a significantly longer period that the previous chromium plating steps. For example, the intermediate chromium plating steps (steps 245 and 255) that occur after the initial chromium plating step (step 235), but before the final chromium plating step (step 265), may be performed for approximately 1-10 minutes (e.g., 5 minutes), whereas the final chromium plating step may be performed for approximately 80-120 minutes (e.g., 100 minutes). In some embodiments, the current density may linearly increase (e.g., from a current density of 0 A/dm$^2$ to a current density of 10 A/dm$^2$) for a period of about one minute and then remain steady for a period of about 100 minutes (e.g., at a current density of 10 A/dm$^2$) while the fourth chromium layer is deposited.

Once the final chromium plating step has been completed, the substrate 115 may be removed from the chromium bath (e.g., by lifting the substrate 115 out of the chromium plating tank 105). Typically, the power source is turned off (or otherwise disconnected from the cathode (the substrate 115) and the anodes 130), and the chromium plating solution is allowed to settle (e.g., for a period of between about 10 seconds and 60 seconds, such as about 20 seconds), prior to removing the substrate from the chromium bath.

The chromium deposited during this process is typically hard chrome. Therefore, the temperature of the chromium bath and the current density used during deposition are typically selected and/or controlled to ensure that hard chrome is deposited.

Figure 3A:
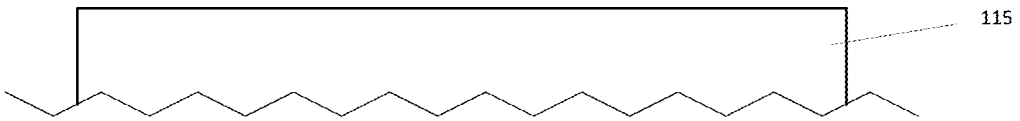
Figure 3B:
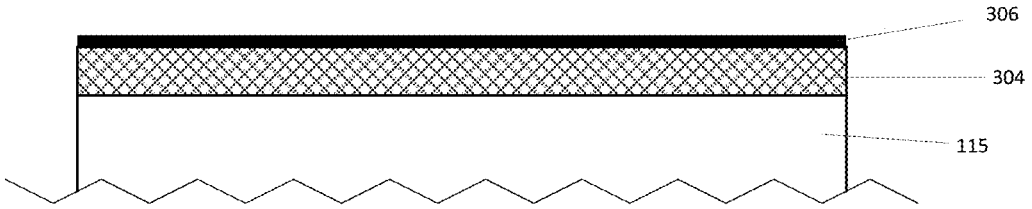
Figure 3C:
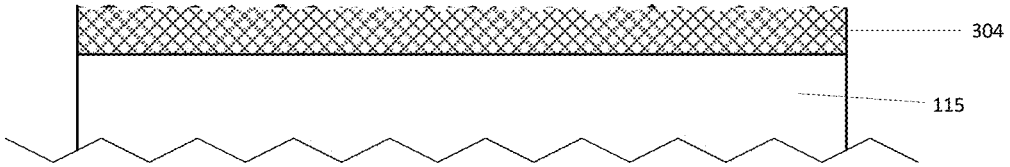
Figure 3D:
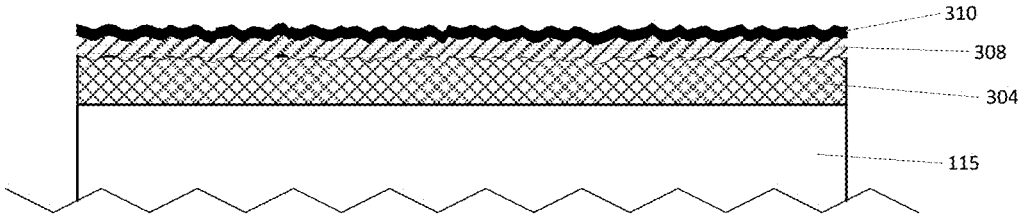
Figure 3E:
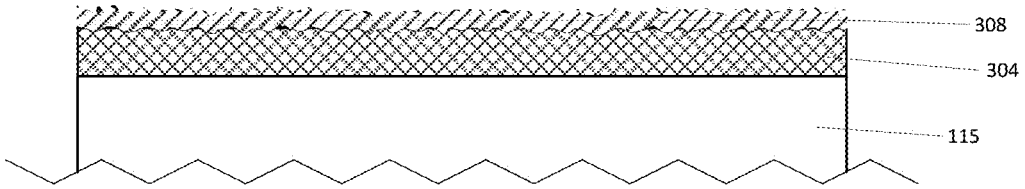
Figure 3F:
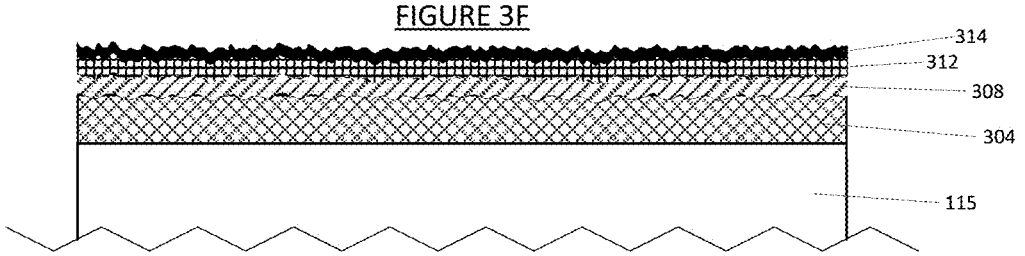
Figure 3G:
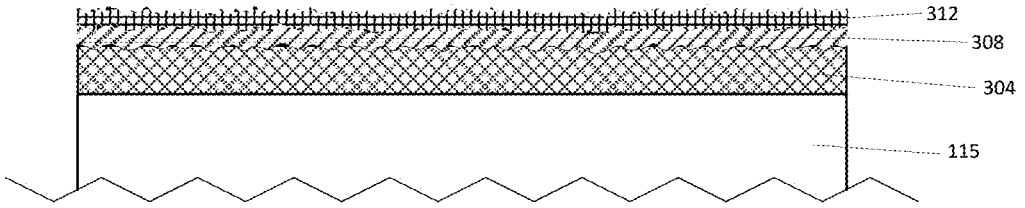
Figure 3H:
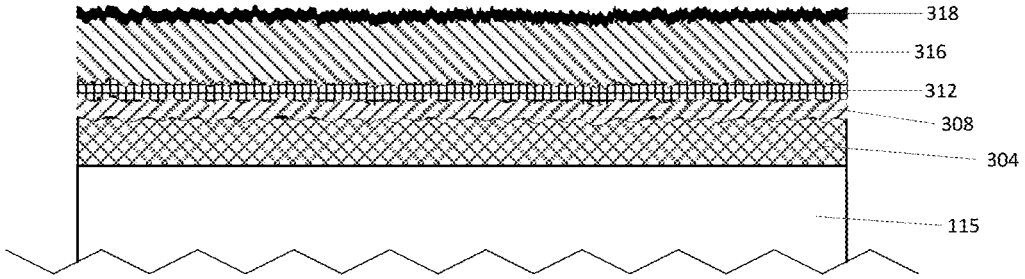

FIGS. 3A-3H depict layers of chromium being deposited and etched on the substrate 115 in accordance with the general process flow 200. FIG. 3A depicts the substrate 115 before chromium has been deposited. FIG. 3B depicts the substrate 115 after an initial chromium layer 304 is deposited in step 235. This initial chromium layer 304 typically includes a chromium oxide layer 306 on its outer surface with chromium metal underneath. FIG. 3C depicts the substrate 115 after the initial chromium layer 304 is etched in step 240. As noted, this etching causes the outer surface of the initial chromium layer 304 to have a microstructure. FIG. 3D depicts the substrate 115 after a second chromium layer 308 is deposited in step 245. This second chromium layer 308 typically includes a chromium oxide layer 310 on its outer surface with chromium metal underneath. As depicted in FIG. 3D, because this second chromium layer 308 is deposited on the microstructure of the initial chromium layer 304, the second chromium layer 308 typically has a rough outer surface after being deposited. FIG. 3E depicts the substrate 115 after the second chromium layer 308 is etched in step 250. As noted, this etching causes the outer surface of the second chromium layer 308 to have a microstructure. FIG. 3F depicts the substrate 115 after a third chromium layer 312 is deposited in step 255. This third chromium layer 312 typically includes a chromium oxide layer 314 on its outer surface with chromium metal underneath. As depicted in FIG. 3F, because this third chromium layer 312 is deposited on the microstructure (and rough surface) of the second chromium layer 308, the third chromium layer 312 typically has a rough outer surface after being deposited. FIG. 3G depicts the substrate 115 after the third chromium layer 312 is etched in step 260. As noted, this etching causes the outer surface of the third chromium layer 312 to have a microstructure. FIG. 3H depicts the substrate 115 after a final chromium layer 316 is deposited in step 265. This final chromium layer 316 typically includes a chromium oxide layer 318 on its outer surface with chromium metal underneath. As depicted in FIG. 3H, because this final chromium layer 316 is deposited on the microstructure (and rough surface) of the third chromium layer 312, the final chromium layer 316 typically has a rough outer surface after being deposited. This rough outer surface of final chromium layer 316 helps to provide a matte appearance.

The above-described alternating steps of chromium plating and etching (i.e., by engaging the one or more current bridges 150) typically cause the chromium deposited on the substrate 115 to have a matte finish. For example, the deposited chromium may have a gloss level of between about 1 and 60 (e.g., between about 30 and 40) as measured at 60° using ASTM D523-14, Standard Test Method for Specular Gloss (2014). In this regard, the etching caused by engaging the current bridge causes deposited chromium to have a microstructure. In addition, by depositing further chromium on this microstructure it is possible to achieve a matte appearance. This matte appearance is provided without subsequent chemical or mechanical processing (e.g., chemical etching or sandblasting) of the chromium deposited on the substrate 115. By performing multiple alternating deposition and etching steps it is possible to achieve a substantially uniform matte appearance. In this regard, although the general process flow 200 is described as having two intermediate chromium plating steps (steps 245 and 255), it is within the scope of the present invention to increase or decrease the number of intermediate chromium plating steps that occur between the initial chromium plating step (step 235) and the final chromium plating step (step 265). For example, it is within the scope of the present invention to include a single intermediate chromium plating step. In other words, the process of the present invention may include: (1) depositing an initial chromium layer, (2) etching the initial chromium layer, (3) depositing an intermediate chromium layer, (4) etching the intermediate chromium layer, and (5) depositing a final/main chromium layer. Alternatively, the process of the present invention may include three or more intermediate chromium plating steps (e.g., by repeating steps 255 and 260 one or more times). Notwithstanding the foregoing, it is also within the scope of present invention for the process described herein to include no intermediate chromium plating steps (e.g., such that steps 245-260 are omitted).

As noted, the deposited chromium may have a gloss level of between about 1 and 60 as measured at 60° using ASTM D523-14, Standard Test Method for Specular Gloss (2014). In particular, and depending on the desired degree of the matte appearance, the deposited chromium may have a gloss level of (i) less than 1, (ii) 2-5, (iii) 5-10, (iv) 10-15, (v) 15-22, (vi) 23-30, (vii) 30-40, or (viii) 40-60 as measured at 60° using ASTM D523-14, Standard Test Method for Specular Gloss (2014). In this regard, the desired degree of the matte appearance of the chromium plating on substrate may be achieved by adjusting the parameters of the foregoing steps. In particular, Applicant has found that reducing the etching that occurs when the one or more current bridges are engaged has the effect of increasing the degree of matte appearance. Applicant has further observed that increasing the etching that occurs when the one or more current bridges are engaged has the effect of reducing the degree of matte appearance. As previously noted, the voltage between the cathode (the substrate 115) and the anodes 130 protects the deposited chromium from being attacked (i.e., etched) by the chromic acid in the chromium plating solution. By increasing the resistance of the chromium plating solution and/or the resistance of the one or more current bridges (e.g., provided by the one or more resistors 156), this voltages breaks down more slowly when the one or more current bridges 150 are engaged, thereby reducing the degree of etching. Moreover, by decreasing the resistance of the this circuit (i.e., the current bridge circuit), such as the combined resistance of the chromium plating solution and the resistance of the one or more current bridges, this voltages breaks down more quickly when the one or more current bridges 150 are engaged, thereby increasing the degree of etching.

Therefore, the gloss level of the chromium plating may be decreased (i.e., the matte appearance may be increased) by: (1) increasing the distance d between the anodes 130 and the substrate 115, which increases the resistance of the chromium plating solution, (2) reducing the temperature of the chromium plating solution, which increases the resistance of the chromium plating solution, and/or (3) increasing the resistance along the one or more current bridges when the bridges are engaged. The gloss level of the chromium plating may be increased (i.e., the matte appearance may be reduced) by: (1) decreasing the distance d between the anodes 130 and the substrate 115, which decreases the resistance of the chromium plating solution, (2) increasing the temperature of the chromium plating solution, which decreases the resistance of the chromium plating solution, and/or (3) decreasing the resistance along the one or more current bridges when the bridges are engaged. It has also been found that the gloss level may be reduced by decreasing the thickness of the final chromium layer (e.g., by decreasing the length of time of the final chromium plating step). Therefore, the gloss level also may be increased by increasing the thickness of the final chromium layer (e.g., by increasing the length of time of the final chromium plating step).

Accordingly, in typical embodiments, the process flow 200 includes controlling the resistance of the current bridge circuit formed by the current bridges 150, the anodes 130, the substrate 115, and the chromium bath (e.g., in order to obtain a desired gloss level of the chromium plating). As noted, the gloss level of the chromium plating is a function of the resistance of the current bridge circuit when such current bridge circuit is closed by the engagement of the current bridges 150. Thus, the gloss level of the chromium plating may be controlled by adjusting a parameter that changes the resistance of the current bridge circuit, such as by (1) controlling the distance d between the anodes 130 and the substrate 115, which affects the resistance of the chromium plating solution, (2) controlling the temperature of the chromium plating solution, which affects the resistance of the chromium plating solution, and/or (3) controlling the resistance (e.g., by adding or removing resistors of a defined resistance or adjusting the resistance of a variable resistor) along the one or more current bridges. These parameters may also be controlled based on other aspects of the chromium plating process. For example, depending on the current density used for chromium plating, the temperature of the chromium bath may be controlled to ensure that hard chrome is deposited.

In some embodiments, one or more of the steps of the general process flow 200 may be performed by the one or more controllers 160. For example, the one or more controllers 160 may perform steps 230-265. By way of further example, the one or more controllers may be configured to control the resistance of the current bridge circuit (e.g., by changing the resistance of the chromium bath, adjusting a variable resistor of a current bridge, or operating an actuator to change the distance d between the anodes 130 and the substrate 115). In addition, the one or more controllers may be able to control inserting the substrate 115 into the chromium plating solution and removing the substrate 115 from the chromium plating solution (e.g., by controlling one or more actuators connected to the cathode bus bar 110 that provide this movement).

Exemplary Process for Chromium Plating a Textured Press Plate

Below is an exemplary process for chromium plating a textured press plate. The steps of this process may be performed manually and/or by a controller.

Initially, a textured stainless steel press plate is provided. The press plate is typically formed from 410- or 630-grade hardened stainless steel having a base surface finish of 7 or higher. The surface of the press plate is rinsed, degreased by electrolytic degreasing (e.g., by cathodic and/or anodic degreasing) and activated.

A chromium bath is prepared. HEEF® 25, which is available from Atotech USA Inc, is employed as the chromium plating solution in this exemplary process. The chromium bath is heated to a temperature of 37° C. Anodes in the chromium bath are configured to be positioned approximately 250 mm from the press plate when the press plate is placed in the chromium bath. The press plate forms a cathode when placed in the chromium bath. In this exemplary process a current bridge is attached to each end of the cathode bus bar from which the press plate is suspended. In this exemplary process, the current bridges do not include a resistor.

Once the press plate has been cleaned and activated, and the chromium bath has been prepared, the press plate is placed in the chromium bath, and the following steps are performed:

1. 2 minutes—rise time to strike (i.e., the power source is turned on and the current density is increased to the current density used in the next step)
2. 4 minutes—deposit a strike on the press plate using a current density of 16 A/dm$^2$
3. 30 minutes—initial chromium plating using a current density of 10 A/dm$^2$
4. 20 seconds—power source off, settling time
5. 12 seconds—engage current bridge between the anodes and cathode
6. 1 minute—rise time for intermediate chromium plating (i.e., the power source is turned on and the current density is increased to the current density used in the next step)
7. 5 minutes—intermediate chromium plating using a current density of 10 A/dm$^2$
8. 20 seconds—power source off, settling time
9. 12 seconds—engage current bridge between the anodes and cathode
10. 1 minute—rise time for intermediate chromium plating (i.e., the power source is turned on and the current density is increased to the current density used in the next step)
11. 5 minutes—intermediate chromium plating using a current density of 10 A/dm$^2$
12. 20 seconds—power source off, settling time
13. 12 seconds—engage current bridge between the anodes and cathode
14. 1 minute—rise time for intermediate chromium plating (i.e., the power source is turned on and the current density is increased to the current density used in the next step)
15. 5 minutes—intermediate chromium plating using a current density of 10 A/dm$^2$
16. 20 seconds—power source off, settling time
17. 12 seconds—engage current bridge between the anodes and cathode 18. 1 minute—rise time for intermediate chromium plating (i.e., the power source is turned on and the current density is increased to the current density used in the next step)
19. 100 minutes—main chromium plating using a current density of 10 A/dm$^2$
20. 20 seconds—power source off, settling time The resulting chromium plated press plate is expected to have a gloss level of approximately 30-40 as measured at 60° using the Gardner gloss meter, which complies with ASTM D523-14, Standard Test Method for Specular Gloss (2014).

FIG. 4 depicts an exemplary apparatus 400 for chromium plating a press plate. The apparatus 400 typically includes a chromium plating tank 402. During chromium plating a chromium plating solution 406 is placed in the chromium plating tank 402. A first plurality of anodes 418A are typically positioned along one interior wall of the chromium plating tank 402. In addition, a second plurality of anodes 418B are typically positioned along an opposing interior wall of the chromium plating tank 402. The first and second plurality of anodes 418A and 418B are typically electrically connected to a positive terminal of a power source (not depicted in FIG. 4). The apparatus 400 typically includes cathode connectors 410 that are electrically connected to a negative terminal of a power source. The cathode connectors 410 are typically configured to hold a cathode bus bar 412. The cathode connectors 410 are also typically configured to provide an electrical connection between the power source and the cathode bus bar 412. The cathode bus bar 412 typically includes one or more connectors 414 for mechanically holding a substrate 416 (e.g., a press plate) as well as for electrically connecting the substrate 416 to the cathode bus bar 412. Although not depicted in FIG. 4, one or more current bridge typically connect the cathode bus bar 412 and the first and second plurality of anodes 418A and 418B is order to provide etching of deposited chromium layers as described herein.

Creating a Chromium-Plated Surface Having Multiple Degrees of Gloss

In another aspect, the present invention embraces a method for creating a chromium-plated surface having multiple degrees of gloss, in which at least a portion of the surface has a matte-chrome finish as described herein. In some instances, rather than creating a surface with a substantially uniform degree of gloss, it may be desirable to create a surface having differing degrees of gloss. In this regard, different gloss-adjusting steps (e.g., polishing or matting) may be employed to form differing degrees of gloss on different portion of a press plate or other substrate. In this aspect of the present invention, instead of employing conventional processes for creating a matte finish (e.g., by chemical etching or sandblasting), the process described herein for created a matte-chrome finish may be applied to a portion of a substrate so that such portion of the substrate has a matte appearance. For example, if the substrate 115 is a textured press plate with a wood-like pattern, chromium with a matte appearance might only be deposited on depressions (e.g., valleys) in the wood-like pattern in order to differentiate such depressions from surrounding portions (e.g., ridges or protrusions) of the wood-like pattern that may have a higher gloss level. Accordingly, in some embodiments, chromium (e.g., chromium with a high-gloss appearance) may have been previously deposited on the substrate 115 prior to the below-described process for creating a chromium-plated surface with a matte finish. In other embodiments, chromium (e.g., chromium with a high-gloss appearance) may be deposited on the substrate 115 after to the below-described process for creating a chromium-plated surface with a matte finish has been completed.

In this regard, FIG. 5 depicts a general process flow 500 for creating a chromium-plate surface with a matte finish on a portion of the substrate in accordance with an embodiment of the present invention. Except as specifically described herein, the steps of the general process flow 500 are substantially the same as the steps of the general process flow 200 described above.

At block 501, a mask is typically applied to (e.g., printed on) the substrate 115 such that the chromium is subsequently deposited (e.g., printed) on only portions of the substrate 115 not covered by such mask. For example, if the substrate 115 is a textured press plate with a wood-like pattern, chromium with a matte appearance might only be deposited on depressions (e.g., valleys) in the wood-like pattern in order to differentiate such depressions from surrounding portions (e.g., ridges or protrusions) of the wood-like pattern that may have a higher gloss level. In some embodiments, chromium (e.g., chromium with a high-gloss appearance) may have been previously deposited on the substrate 115 prior to the process flow 500 for creating a chromium-plated surface with a matte finish. The mask may be formed from a chemically resistant ink (e.g., a hot-melt ink) or other material.

At step 505, the surface of the substrate 115 (e.g., a textured stainless steel press plate) is rinsed to remove contaminants. Next, at step 510, the surface of the substrate 115 is degreased (e.g., by manually applying a suitable solvent) to remove any oil and grease and subsequently rinsed. At step 520, the surface of the press plate is activated, such as by exposing the substrate 115 to sulfuric acid or a reverse etch bath having a chromic acid solution with no sulfate. Thereafter, the substrate 115 may be rinsed again. Alternatively, the surface of the substrate 115 may be activated by pickling, namely by exposing the surface to a strong acid.

Once the substrate 115 has been cleaned and activated (e.g., using the process described with respect to steps 505-520), the substrate 115 may be chromium plated. In this regard, at step 525, the substrate 115 is placed in a chromium bath. At step 530, a strike is deposited on the surface of the substrate 115 by supplying current from the power source 120 to the one or more anodes 130 and the cathode (e.g., by turning on the power source 120).

After the strike has been deposited on the surface of the substrate 115, at step 535, an initial chromium layer (e.g., of a desired thickness) is deposited on the substrate 115 (i.e., on the previously deposited strike) by supplying current from the power source 120 to the one or more anodes 130 and the cathode. The thickness of the chromium layer deposited as a result of this chromium plating step is typically based, among other things, on the length of time of this chromium plating step. Because etching is subsequently performed, it is typically desirable to ensure that this chromium layer is of sufficient thickness so that subsequent etching does not etch entirely through the chromium layer to the substrate 115. That said, it is also desirable to ensure that chrome plating solution does not undesirably degrade the mask (e.g., such that portions of the mark are undesirably etched away so as to expose the substrate underneath). Accordingly, this initial chromium plating step is typically performed for a period of time (e.g., between about 2-10 minutes, such as about 2-5 minutes) that is not too long so as to expose the mask to undesirable degradation but of sufficient length so that this deposited chromium layer has a sufficient thickness to ensure subsequent etching does not etch through this initial chromium layer to the substrate 115. That said, in some embodiments, a layer of chromium is deposited on the substrate 115 prior to initiating process flow 500, thereby reducing the likelihood of etching through to the substrate 115. Once this chromium plating step is complete, the power source 120 is typically turned off (or otherwise does not supply current to the cathode (the substrate 115) and the anodes 130).

Next, at block 540, the initial chromium layer is etched by engaging the one or more current bridges 150 by closing each current bridge's switch 155. The one or more current bridges 150 typically remain engaged for a relatively short period of time, typically between about 5-30 seconds, more typically between about 10-20 seconds (e.g., 12 seconds). As noted, during this period of time, flowing current causes the voltage between the cathode and the anodes 130 to breakdown, thereby allowing the chromic acid in the chromium plating solution to etch the initial chromium layer. After this period of time, the one or more current bridges 150 are typically disengaged (e.g., by opening each current bridge's switch 155), thereby ceasing this current flow and the etching of the initial chromium layer.

After the one or more current bridges 150 are disengaged, at step 545, power is again supplied by the power source 120, and a second chromium layer is deposited on the etched initial chromium layer. The thickness of the second chromium layer may be similar to the thickness of the initial chromium layer. In this regard, this step 545 of chromium plating to achieve the second chromium layer may occur for a period of between about two minutes and ten minutes (e.g., about five minutes).

At step 550, the second chromium layer is etched by engaging the one or more current bridges 150 a second time (e.g., by closing each current bridge's switch 155). At step 555, the one or more current bridges 155 are disengaged, power is again supplied by the power source 120, and chromium plating of the surface of the substrate 115 is continued by depositing a third chromium layer. The thickness of the third chromium layer may be similar to the thickness of the initial chromium layer. In this regard, this step 555 of chromium plating to achieve the third chromium layer may occur for a period of between about two minutes and ten minutes (e.g., about five minutes).

At step 560, the third chromium layer is etched by engaging the one or more current bridges 150 a third time (e.g., by closing each current bridge's switch 155).

At step 565, the one or more current bridges 155 are disengaged, power is again supplied by the power source 120, and chromium plating of the surface of the substrate 115 is continued by depositing a fourth chromium layer. Typically, the mask is removed prior to the deposition of the fourth chromium layer. Once the mask is removed, those areas of the substrate 115 not covered by the mask would be plated with matte chrome (i.e., chromium having a matte appearance), whereas the portions of the substrate 115 previously covered by the mask would typically not be plated with matte chrome. If the mask has been removed, then the fourth chromium layer may be substantially thicker than the previous chromium layers. Accordingly, this fourth chromium plating is typically performed for a significantly longer period that the previous chromium plating steps. That said, if the mask has not yet been removed, then the fourth chromium layer would typically have a thickness that is similar to the thickness of the previous chromium layers. If the mask has not been removed prior to the deposition of the fourth chromium layer, then, following deposition of the fourth chromium layer, the mask may be removed and a further layer of chromium may be applied to the entire surface of the substrate 115. For example, chromium with a high-gloss appearance may be deposited on the substrate 115 after the mask has been removed.

The chromium deposited during this process is typically hard chrome. Therefore, the temperature of the chromium bath and the current density used during deposition are typically selected and/or controlled to ensure that hard chrome is deposited.

As with the general process flow 200 described above, although the general process flow 500 is described as having two intermediate chromium plating steps (steps 545 and 555), it is within the scope of the present invention to increase or decrease the number of intermediate chromium plating steps that occur between the initial chromium plating step (step 535) and the final chromium plating step (step 565). Also like the general process flow 200 described above, the general process flow 500 may include controlling the resistance of the current bridge circuit formed by the current bridges 150, the anodes 130, the substrate 115, and the chromium bath (e.g., in order to obtain a desired gloss level of the chromium plating). In some embodiments, one or more of the steps of the general process flow 500 may be performed by the one or more controllers 160. For example, the one or more controllers 160 may perform steps 530-565. By way of further example, the one or more controllers may be configured to control the resistance of the current bridge circuit. In addition, the one or more controllers may be able to control inserting the substrate 115 into the chromium plating solution and removing the substrate 115 from the chromium plating solution.

Exemplary Process for Chromium Plating a Portion of a Textured Press Plate

Below is an exemplary process for chromium plating a portion of a textured press plate. The steps of this process may be performed manually and/or by a controller.

Initially, a textured stainless steel press plate is provided. The press plate is typically formed from 410- or 630-grade hardened stainless steel having a base surface finish of 7 or higher. The surface of the press plate is rinsed, degreased, and activated.

A chromium bath is prepared. HEEF® 25, which is available from Atotech USA Inc, is employed as the chromium plating solution in this exemplary process. The chromium bath is heated to a temperature of 37° C. Anodes in the chromium bath are configured to be positioned approximately 250 mm from the press plate when the press plate is placed in the chromium bath. The press plate forms a cathode when placed in the chromium bath. In this exemplary process a current bridge is attached to each end of the cathode bus bar from which the press plate is suspended. In this exemplary process, the current bridges do not include a resistor.

A mask is applied to the press plate, and then press plate is cleaned and activated. Once the press plate has been cleaned and activated, and the chromium bath has been prepared, the press plate is placed in the chromium bath, and the following steps are performed:

1. 3 minutes—rise time to strike (i.e., the power source is turned on and the current density is increased to the current density used in the next step)
2. 2 minutes—deposit a strike on the press plate using a current density of 16 A/dm$^2$
3. 4 minutes—initial chromium plating using a current density of 10 A/dm$^2$
4. 15 seconds—power source off, settling time 5. 12 seconds—engage current bridge between the anodes and cathode
6. 30 seconds—rise time for intermediate chromium plating (i.e., the power source is turned on and the current density is increased to the current density used in the next step)
7. 3 minutes—intermediate chromium plating using a current density of 10 $A/dm^2$
8. 15 seconds—power source off, settling time
9. 12 seconds—engage current bridge between the anodes and cathode
10. 30 seconds—rise time for intermediate chromium plating (i.e., the power source is turned on and the current density is increased to the current density used in the next step)
11. 3 minutes—intermediate chromium plating using a current density of 10 $A/dm^2$
12. 15 seconds—power source off, settling time
13. 12 seconds—engage current bridge between the anodes and cathode
14. 30 seconds—rise time for intermediate chromium plating (i.e., the power source is turned on and the current density is increased to the current density used in the next step)
15. 3 minutes—intermediate chromium plating using a current density of 10 $A/dm^2$ The portions of the resulting chromium plated press plate not covered by the mask are expected to have a gloss level of no more than about 5 as measured at 60° using the Gardner gloss meter, which complies with ASTM D523-14, Standard Test Method for Specular Gloss (2014).

Thereafter, the mask is typically removed and the entire surface of the press plate is chromium plated (including portions of the press plate previously covered by the mask and portions of press plate having matte chrome) by performing the following steps: (i) 3 minutes—rise time to strike, (ii) 2 minutes—deposit a strike on the press plate using a current density of 16 $A/dm_2$, (iii) 30 minutes—chromium plating using a current density of 10 $A/dm^2$. The portions of the resulting chromium plated press plate not previously covered by the mask are expected to have a gloss level of approximately 11-13 as measured at 60° using the Gardner gloss meter, which complies with ASTM D523-14, Standard Test Method for Specular Gloss (2014).

As will be appreciated by one of skill in the art, the present invention may be embodied as a method (including, for example, a computer-implemented process, a business process, and/or any other process), apparatus (including, for example, a system, machine, device, computer program product, and/or the like), or a combination of the foregoing. Accordingly, embodiments of the present invention may take the form of an entirely hardware embodiment, an entirely software embodiment (including firmware, resident software, micro-code, and the like), or an embodiment combining software and hardware aspects that may generally be referred to herein as a "system." Furthermore, embodiments of the present invention may take the form of a computer program product on a computer-readable medium having computer-executable program code embodied in the medium.

Any suitable transitory or non-transitory computer readable medium may be utilized. The computer readable medium may be, for example but not limited to, an electronic, magnetic, optical, electromagnetic, infrared, or semiconductor system, apparatus, or device. More specific examples of the computer readable medium include, but are not limited to, the following: an electrical connection having one or more wires; a tangible storage medium such as a portable computer diskette, a hard disk, a random access memory (RAM), a read-only memory (ROM), an erasable programmable read-only memory (EPROM or Flash memory), a compact disc read-only memory (CD-ROM), or other optical or magnetic storage device.

In the context of this document, a computer readable medium may be any medium that can contain, store, communicate, or transport the program for use by or in connection with the instruction execution system, apparatus, or device. The computer usable program code may be transmitted using any appropriate medium, including but not limited to the Internet, wireline, optical fiber cable, radio frequency (RF) signals, or other mediums.

Computer-executable program code for carrying out operations of embodiments of the present invention may be written in an object oriented, scripted or unscripted programming language. However, the computer program code for carrying out operations of embodiments of the present invention may also be written in conventional procedural programming languages, such as the "C" programming language or similar programming languages.

Embodiments of the present invention are described above with reference to flowchart illustrations and/or block diagrams of methods, apparatus (systems), and computer program products. It will be understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks.

These computer-executable program code portions may also be stored in a computer-readable memory that can direct a computer or other programmable data processing apparatus to function in a particular manner, such that the code portions stored in the computer readable memory produce an article of manufacture including instruction mechanisms which implement the function/act specified in the flowchart and/or block diagram block(s).

The computer-executable program code may also be loaded onto a computer or other programmable data processing apparatus to cause a series of operational steps to be performed on the computer or other programmable apparatus to produce a computer-implemented process such that the code portions which execute on the computer or other programmable apparatus provide steps for implementing the functions/acts specified in the flowchart and/or block diagram block(s). Alternatively, computer program implemented steps or acts may be combined with operator or human implemented steps or acts in order to carry out an embodiment of the invention.

As the phrase is used herein, a processor (or other device) may be "configured to" perform a certain function in a variety of ways, including, for example, by having one or more general-purpose circuits perform the function by executing particular computer-executable program code embodied in computer-readable medium, and/or by having one or more application-specific circuits perform the function.

Embodiments of the present invention are described above with reference to flowcharts and/or block diagrams. It will be understood that steps of the processes described herein may be performed in orders different than those illustrated in the flowcharts. In other words, the processes represented by the blocks of a flowchart may, in some embodiments, be in performed in an order other that the order illustrated, may be combined or divided, or may be performed simultaneously. It will also be understood that the blocks of the block diagrams illustrated, in some embodiments, merely conceptual delineations between systems and one or more of the systems illustrated by a block in the block diagrams may be combined or share hardware and/or software with another one or more of the systems illustrated by a block in the block diagrams. Likewise, a device, system, apparatus, and/or the like may be made up of one or more devices, systems, apparatuses, and/or the like. For example, where a processor is illustrated or described herein, the processor may be made up of a plurality of microprocessors or other processing devices which may or may not be coupled to one another. Likewise, where a memory is illustrated or described herein, the memory may be made up of a plurality of memory devices which may or may not be coupled to one another.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

The invention claimed is:

1. A method of creating, on a substrate, a chrome-plated surface having a matte finish, comprising:

controlling a resistance of a current bridge circuit;

depositing a first chromium layer on the substrate, the substrate being positioned in a chromium bath, wherein the first chromium layer is deposited by supplying current from a power source, the power source being electrically connected to the substrate and to one or more terminals positioned in the chromium bath;

etching the first chromium layer, wherein the first chromium layer is etched by engaging a current bridge, the current bridge, when engaged, forming an electrical connection between the substrate and the one or more terminals that closes the current bridge circuit, the current bridge circuit comprising the current bridge, terminals, substrate, and chromium bath, wherein the power source does not supply current to the current bridge circuit while the current bridge is engaged.

2. The method of claim 1, comprising:

depositing a first intermediate chromium layer on the first chromium layer after the first chromium layer has been etched, wherein the first intermediate chromium layer is deposited by supplying current from the power source;

etching the first intermediate chromium layer, wherein the first intermediate chromium layer is etched by engaging the current bridge; and after the first intermediate chromium layer has been etched, depositing a final chromium layer, wherein the final chromium layer is deposited by supplying current from the power source.

3. The method of claim 2, comprising:

depositing a second intermediate chromium layer on the first intermediate chromium layer after the first intermediate chromium layer has been etched, wherein the second intermediate chromium layer is deposited by supplying current from the power source; and etching the second intermediate chromium layer, wherein second first intermediate chromium layer is etched by engaging the current bridge; and wherein the final chromium layer is deposited after the second intermediate chromium layer has been etched.

4. The method of claim 2, wherein, once the final chromium layer has been deposited, the chrome-plated surface of the substrate has a gloss level of about thirty to forty as measured at 60° using ASTM D523-14, Standard Test Method for Specular Gloss (2014).

5. The method of claim 1, wherein the current bridge is disengaged while the power source supplies current.

6. The method of claim 1, wherein the current bridge comprises a switch, wherein the current bridge is engaged by closing the switch, and wherein the current bridge is disengaged by opening the switch.

7. The method of claim 1, wherein:

when the power source is supplying current, current flows from the one or more terminals to the substrate; and when the current bridge is engaged, current flows from the substrate to the one or more terminals.

8. The method of claim 1, wherein etching the first chromium layer forms a microstructure in the first chromium layer.

9. The method of claim 1, wherein etching the first chromium layer comprises etching an outer chromium oxide layer of the first chromium layer.

10. The method of claim 1, wherein the one or more terminals positioned in the chromium bath comprise one or more anodes positioned in the chromium bath.

11. The method of claim 1, wherein controlling the resistance of the current bridge circuit comprises:

controlling a resistance of the chromium bath; controlling a temperature of the chromium bath; and/or controlling a distance between the substrate and the one or more terminals.

12. The method of claim 1, wherein:

the current bridge comprises a resistor; and controlling the resistance of the current bridge circuit comprises controlling a resistance of the resistor.

13. The method of claim 1, wherein controlling the resistance of the current bridge circuit comprises controlling the resistance of the current bridge circuit so that the resistance of the current bridge circuit is between about 0.1 milliohms and 20 milliohms when the current bridge circuit is closed.

14. The method of claim 1, wherein controlling the resistance of the current bridge circuit comprises controlling the resistance of the current bridge circuit so that the resistance of the current bridge circuit is between about 0.8 milliohms and 8 milliohms when the current bridge circuit is closed.

15. The method of claim 1, comprising, prior to depositing the first chromium layer on the substrate, applying a mask to one or more portions of the substrate.

16. The method of claim 15, comprising:

removing the mask; and after removing the mask, depositing a final chromium layer.

17. The method of claim 15, comprising:

prior to applying the mask to the one or more portions of the substrate, depositing a chromium layer on the substrate;

depositing a final chromium layer; and after depositing the final chromium layer, removing the mask.

18. The method of claim 1, where, while the current bridge is engaged, current flows through the current bridge circuit.

19. The method of claim 18, wherein, while the current bridge is engaged, a direction that current flows between the substrate and the one or more terminals is opposite from the direction that current flows when the power source is supplying current.

* * * * *